US012292198B2

(12) United States Patent
Singh et al.

(10) Patent No.: US 12,292,198 B2
(45) Date of Patent: May 6, 2025

(54) ROTATING DETONATION COMBUSTOR WITH DISCRETE DETONATION ANNULI

(71) Applicant: General Electric Company, Schenectady, NY (US)

(72) Inventors: Kapil Kumar Singh, Rexford, NY (US); Narendra Digamber Joshi, Schenectady, NY (US)

(73) Assignee: GENERAL ELECTRIC COMPANY, Evendale, OH (US)

( * ) Notice: Subject to any disclaimer, the term of this patent is extended or adjusted under 35 U.S.C. 154(b) by 144 days.

(21) Appl. No.: 16/267,473

(22) Filed: Feb. 5, 2019

(65) Prior Publication Data

US 2020/0248905 A1 Aug. 6, 2020

(51) Int. Cl.
*F23R 7/00* (2006.01)
*F23R 3/28* (2006.01)

(52) U.S. Cl.
CPC ..... *F23R 7/00* (2013.01); *F23R 3/286* (2013.01)

(58) Field of Classification Search
CPC ..... F23R 7/00
See application file for complete search history.

(56) References Cited

U.S. PATENT DOCUMENTS 2,589,215 A * 3/1952 Atwood ..... F02K 7/08 60/267
3,240,010 A * 3/1966 Morrison ..... F02K 9/66 60/247
4,455,840 A * 6/1984 Matt ..... F23R 3/10 60/737
6,526,936 B2 3/2003 Nalim
6,883,302 B2 4/2005 Koshoffer
9,512,805 B2 12/2016 Snyder
9,732,670 B2 8/2017 Joshi et al.
9,816,463 B2 * 11/2017 Falempin ..... F23R 7/00
(Continued)

FOREIGN PATENT DOCUMENTS

CN 109028144 A 12/2018
JP 2017142044 A 8/2017

OTHER PUBLICATIONS

Lu et al "Rotating Detonation Wave Propulsion: Experimental Challenges, Modeling, and Engine Concepts" Journal of Propulsion and Power vol. 30, No. 5, Sep.-Oct. 2014, pp. 1125-1142. (Year: 2014).*

*Primary Examiner* — Ted Kim
(74) *Attorney, Agent, or Firm* — Venable LLP; Peter T. Hrubiec; Michele V. Frank

(57) ABSTRACT

The present disclosure is directed to a rotating detonation combustor that includes a forward wall, a radially inner wall, and a radially outer wall. The forward wall is disposed at an inlet end of the rotating detonation combustor. The radially inner wall surrounds a longitudinal axis and extends downstream from the forward wall to an outlet end of the rotating detonation combustor. The radially outer wall extends downstream from the forward wall to the outlet end and surrounds the radially inner wall to define at least one annular plenum between the radially inner wall and the radially outer wall. At least one partition is proximate to the inlet end and defines at least two mixing zones. A plurality of oxidizer inlets and a plurality of fuel inlets are disposed at the inlet end in fluid communication with the at least two mixing zones.

19 Claims, 7 Drawing Sheets

(56) References Cited

U.S. PATENT DOCUMENTS

| | | | | |
|---|---|---|---|---|
| 9,856,791 | B2 | 1/2018 | Muller et al. | |
| 2012/0151898 | A1* | 6/2012 | Claflin | F23R 7/00 60/247 |
| 2015/0128599 | A1* | 5/2015 | Snyder | F23R 7/00 60/734 |
| 2017/0146244 | A1* | 5/2017 | Kurosaka | F23R 3/10 |
| 2018/0080412 | A1* | 3/2018 | Mizener | F23R 7/00 |
| 2018/0179952 | A1 | 6/2018 | Peter et al. | |
| 2018/0179953 | A1 | 6/2018 | Tangirala et al. | |
| 2018/0180289 | A1* | 6/2018 | Lavertu, Jr. | F23R 7/00 |
| 2018/0231256 | A1 | 8/2018 | Pal et al. | |
| 2018/0274439 | A1 | 9/2018 | Holley et al. | |
| 2018/0274788 | A1* | 9/2018 | Greene | F23R 7/00 |
| 2018/0355792 | A1 | 12/2018 | Pal et al. | |
| 2018/0355822 | A1 | 12/2018 | Vise et al. | |
| 2018/0356093 | A1 | 12/2018 | Pal et al. | |
| 2018/0356094 | A1 | 12/2018 | Zelina et al. | |

* cited by examiner

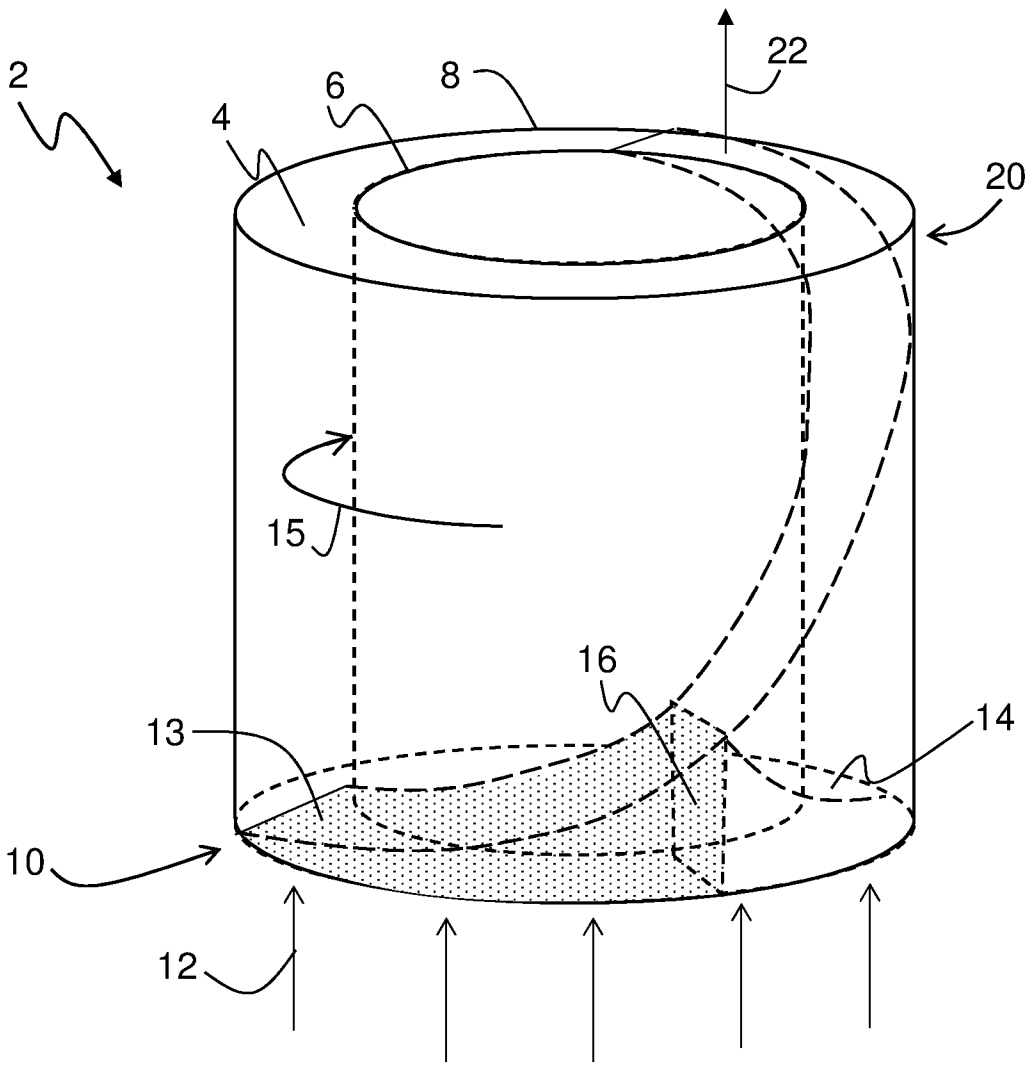
— FIG. 1 —

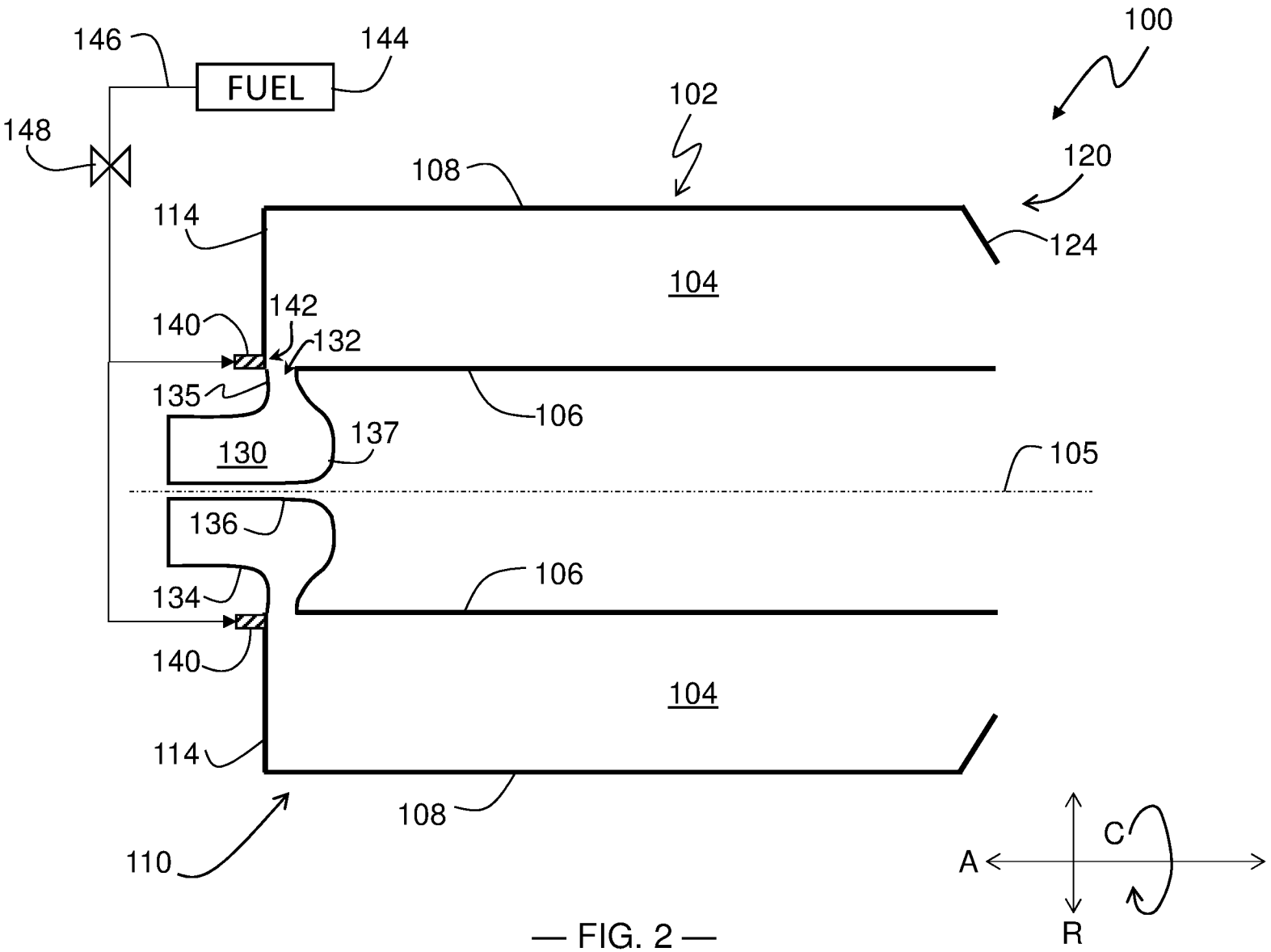
— FIG. 2 —

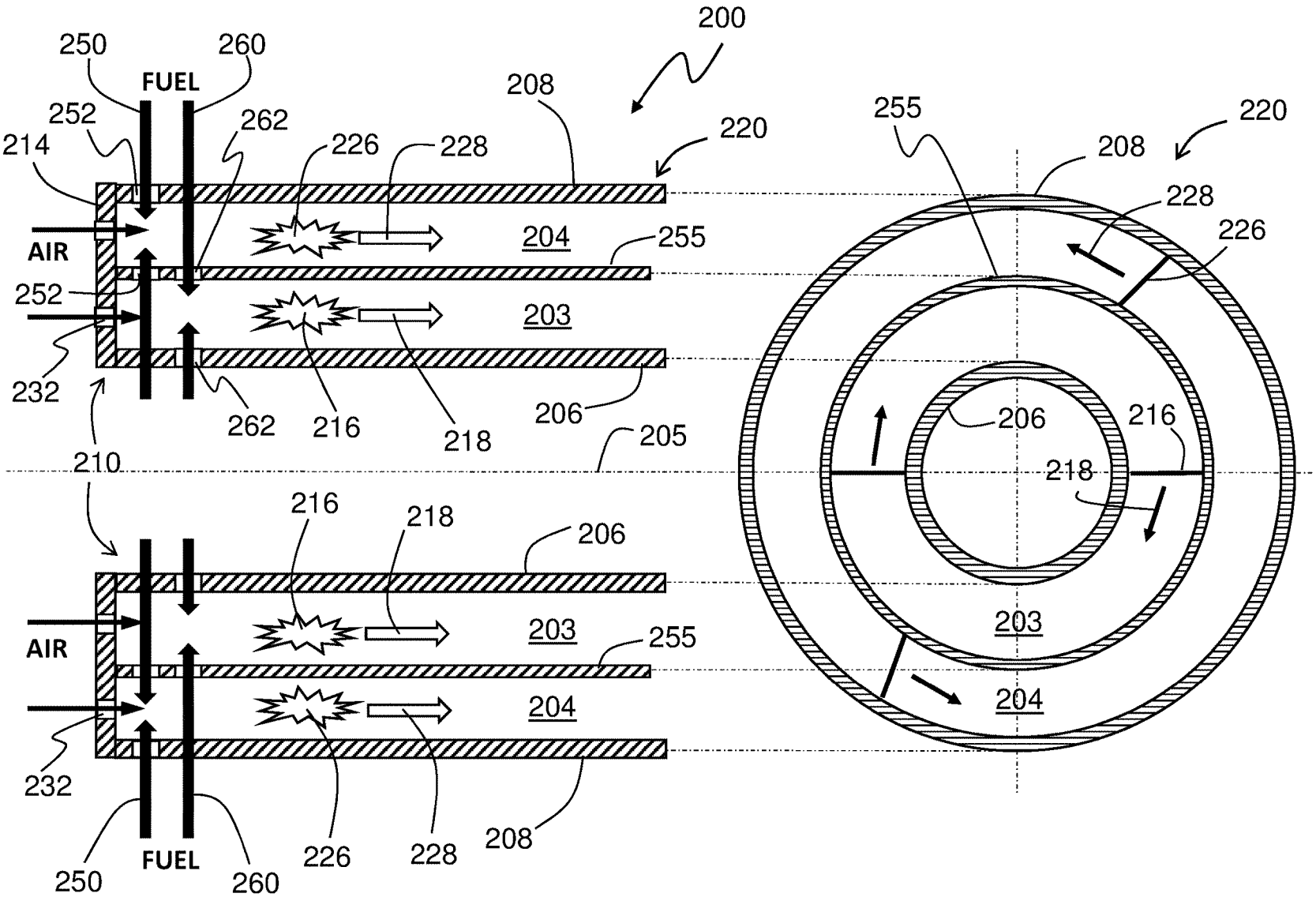
— FIG. 3 —

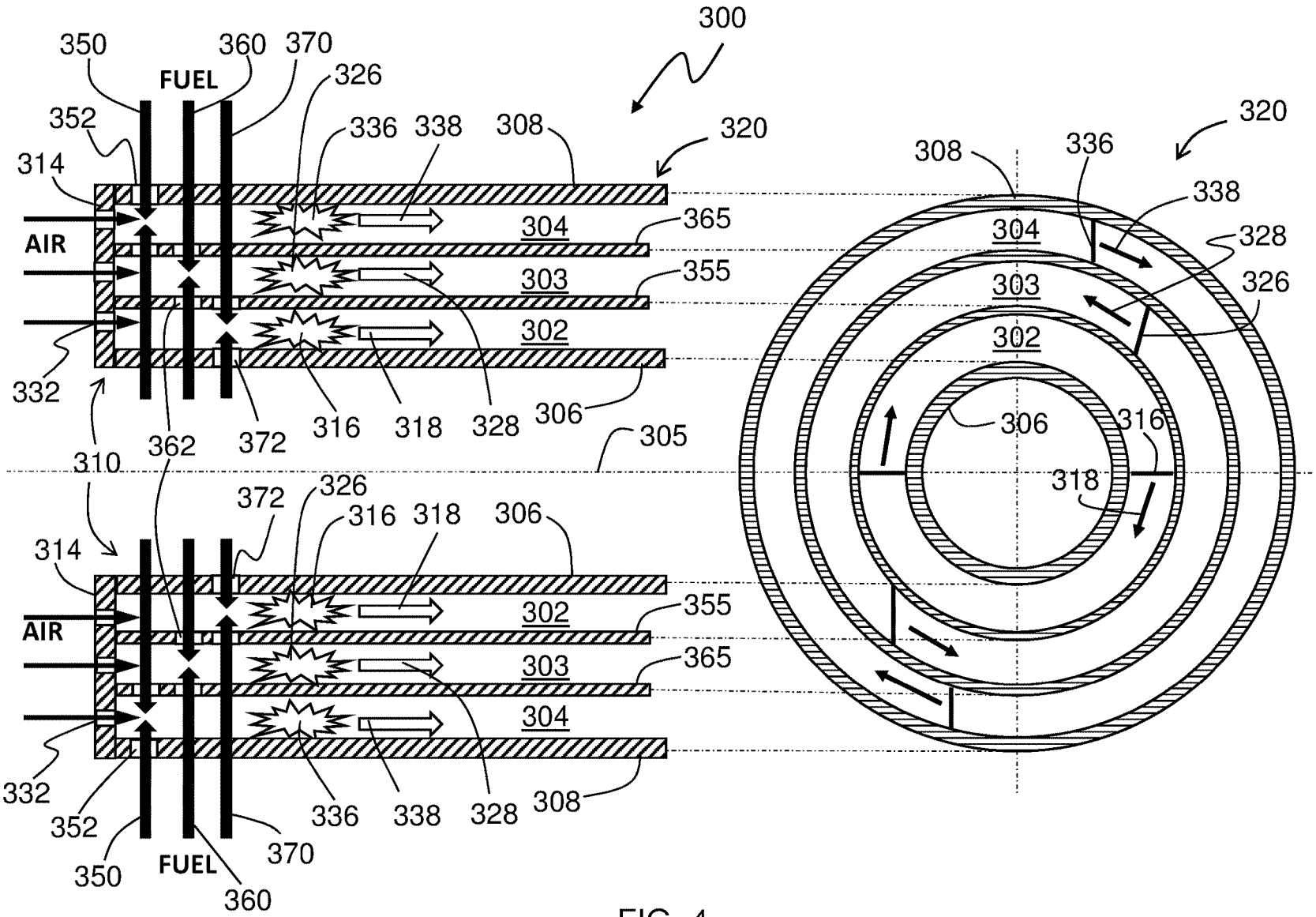
— FIG. 4 —

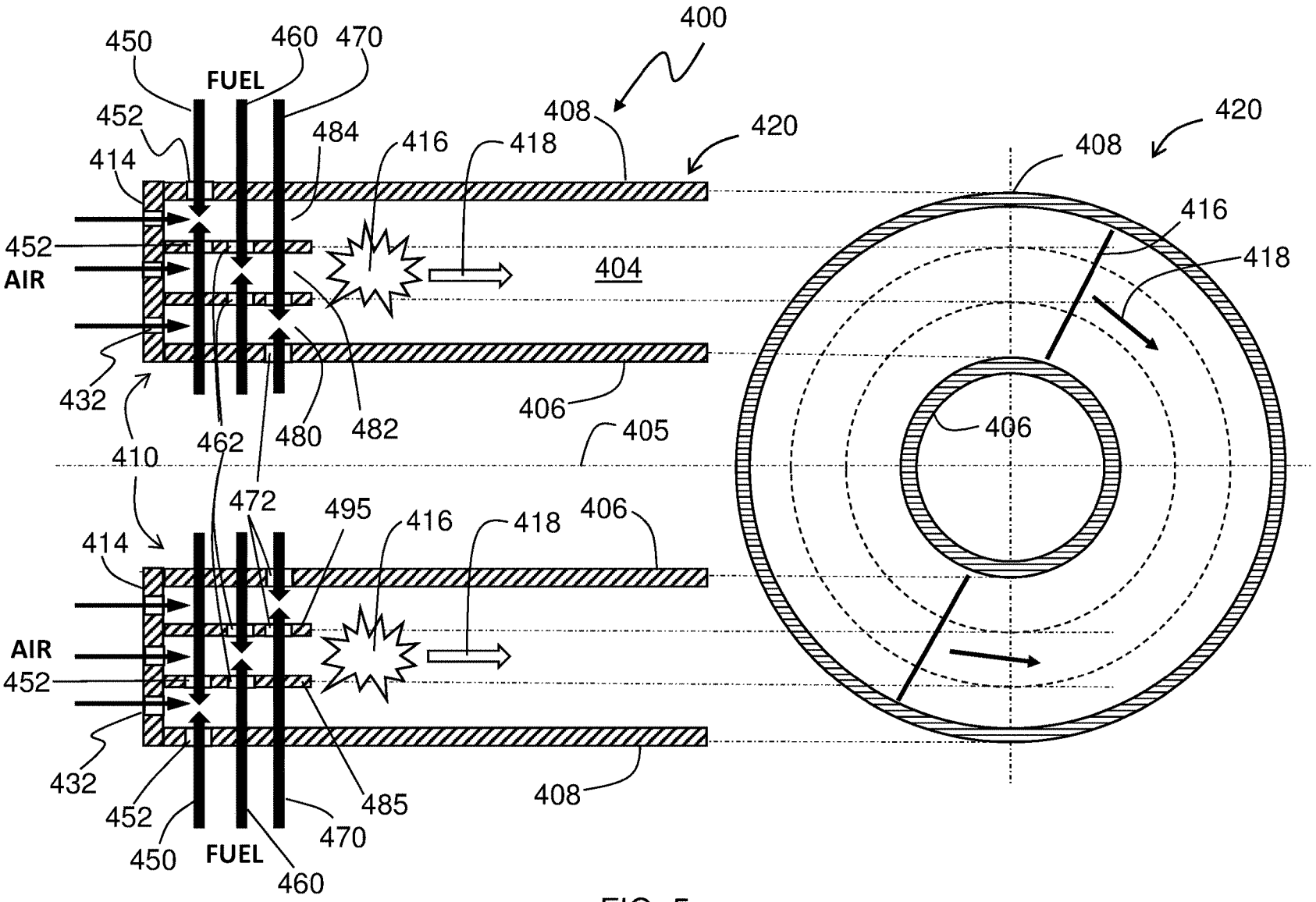
— FIG. 5 —

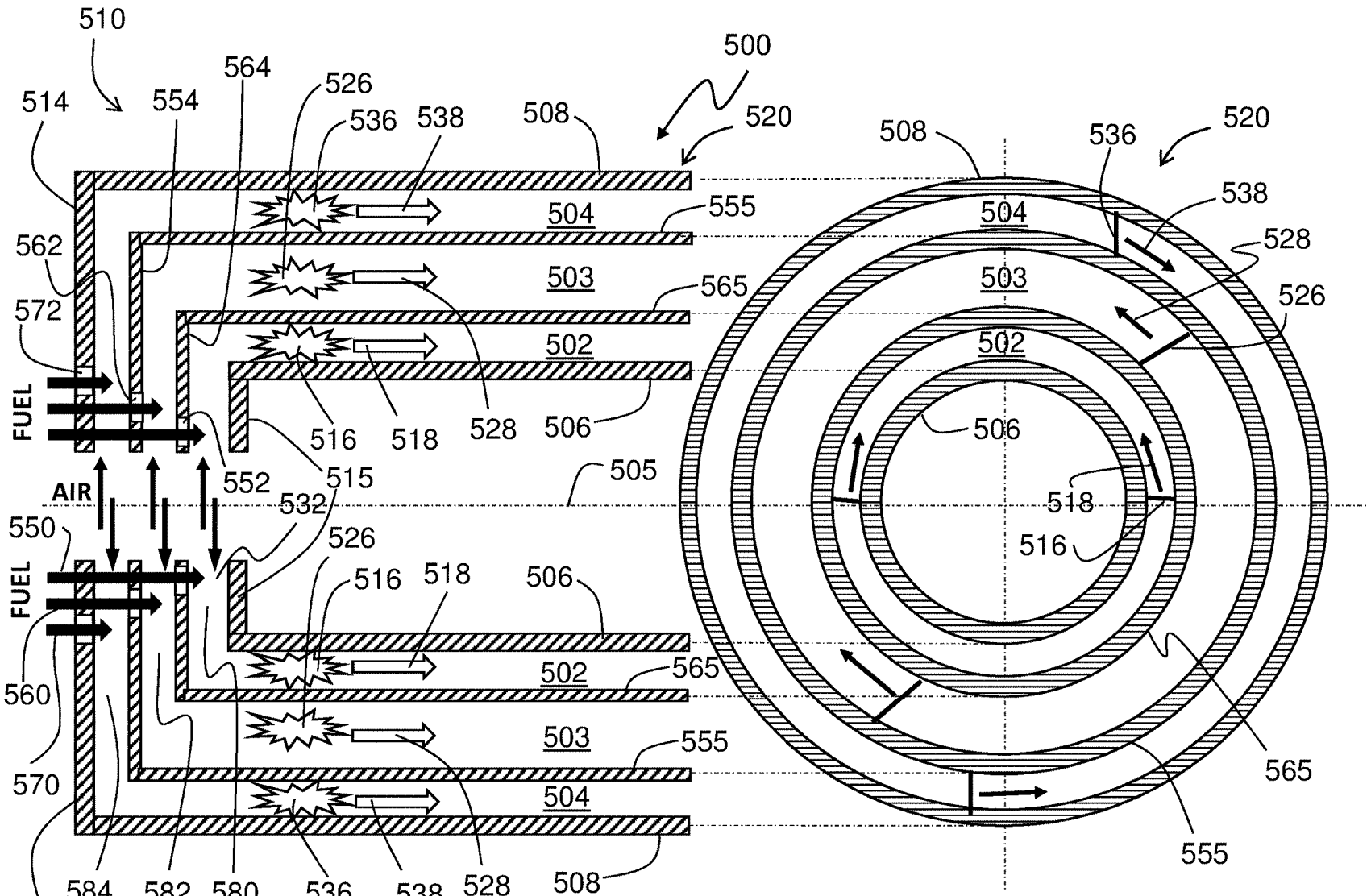
— FIG. 6 —

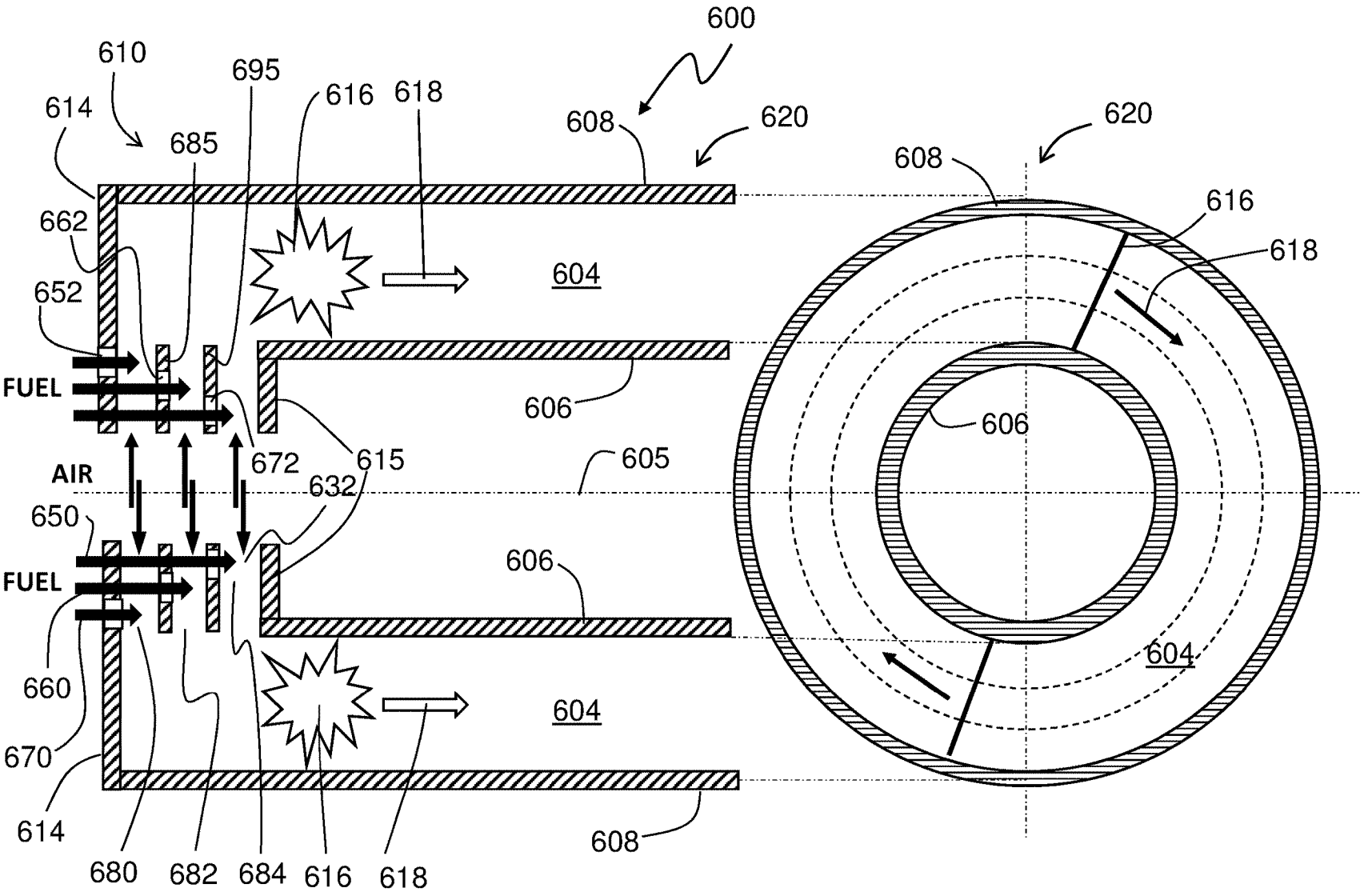
— FIG. 7 —

ROTATING DETONATION COMBUSTOR WITH DISCRETE DETONATION ANNULI

TECHNICAL FIELD

The present disclosure relates generally to the field of gas turbine engines and, more particularly, to rotating detonation combustors with discrete detonation annuli.

BACKGROUND

Some conventional turbo machines, such as gas turbine systems, are utilized to generate electrical power or to provide propulsion for aircraft. In general, gas turbine systems include a compressor, a combustor, and a turbine. Air may be drawn into a compressor, via its inlet end, where the air is compressed by passing through multiple stages of rotating blades and stationary nozzles. The compressed air is mixed with fuel and burned in a combustor, and the resulting combustion products (hot gases) are directed to a turbine to convert the thermal and kinetic energy into work.

Rotating detonation combustors, which are currently the subject of considerable worldwide research, are believed to offer an efficiency benefit over pulse detonation combustors and conventional deflagrative combustors. The combustion process begins when a fuel/oxidizer (e.g., air) mixture in a tube or pipe structure is ignited via a spark or another suitable ignition source to generate a compression wave. The compression wave is followed by a chemical reaction that transitions the compression wave to a detonation wave. The detonation wave travels circumferentially and axially through the combustion chamber defined by the tube. As air and fuel are fed into the combustion chamber, they are consumed by the detonation wave. As the detonation wave consumes air and fuel, combustion products traveling along the combustion chamber accelerate and are discharged from the combustion chamber.

Specifically, as shown in FIG. 1, a rotating detonation combustor 2 includes an inner wall 6 and an outer wall 8 that together define an annular passage 4. The combustor 2 has an inlet end 10 defined by a forward wall 14 and into which the compressed air from the compressor (not shown) is introduced for mixing with fuel. Once ignited at the detonation front 16, the fuel and air mixture 12 produces one or more self-sustaining detonation waves that travel in a circumferential direction 15 as an oblique shock wave 18 through the annular passage 4 (i.e., around a longitudinal axis of the combustor 2) and that provide a high-pressure region 16 proximate to the detonation front 16. As the waves 18 travel through the annulus 4, the incoming reactant fill 13 is consumed, which helps to push the combustion products 22 from the annular passage 4. The combustion products 22 exit the combustor 2, via the outlet end 20, for delivery to the turbine (not shown).

The combustion products 22 flow through a fluid flow path in a turbine, which is defined between a plurality of rotating blades and a plurality of stationary nozzles disposed between the rotating blades, such that each set of rotating blades and each corresponding set of stationary nozzles defines a turbine stage. Typically, the rotation of the turbine blades also causes rotation of the compressor blades, which are coupled to the rotor.

In the development of rotating detonation combustors, the paradigm has been to use a common annulus for the detonation of the fuel/air mixture and the transmission of a single shock wave. However, inadequate mixing can lead to inefficient performance, thereby degrading the benefits of the rotating detonation combustor. Additionally, when detonation occurs within a single annulus, the volumetric heat release associated with the detonation operation is concentrated, which can lead to thermomechanical design challenges.

SUMMARY

The present disclosure is directed to a rotating detonation combustor. The rotating detonation combustor includes a forward wall, a radially inner wall, and a radially outer wall. The forward wall is disposed at an inlet end of the rotating detonation combustor. The radially inner wall surrounds a longitudinal axis and extends downstream from the forward wall to an outlet end of the rotating detonation combustor. The radially outer wall extends downstream from the forward wall to the outlet end and surrounds the radially inner wall to define at least one annular plenum between the radially inner wall and the radially outer wall. At least one partition is proximate to the inlet end and defines at least two mixing zones. A plurality of oxidizer inlets and a plurality of fuel inlets are disposed at the inlet end in fluid communication with the at least two mixing zones.

BRIEF DESCRIPTION OF THE DRAWINGS

The specification, directed to one of ordinary skill in the art, sets forth a full and enabling disclosure of the present system and method, including the best mode of using the same. The specification refers to the appended figures, in which:

FIG. 1 is schematic illustration of a rotating detonation combustor, according to conventional practice;

FIG. 2 is schematic cross-section of a rotating detonation combustor, according to one aspect of the present rotating detonation combustor;

FIG. 3 is a schematic depiction of a cross-section and an end view of a first exemplary rotating detonation combustor in which the oxidizer is introduced in an axial direction into two discrete annuli, according to a first aspect of the present disclosure;

FIG. 4 is a schematic depiction of a cross-section and an end view of a second exemplary rotating detonation combustor in which the oxidizer is introduced in an axial direction into three discrete annuli, according to a second aspect of the present disclosure;

FIG. 5 is a schematic depiction of a cross-section and an end view of a third exemplary rotating detonation combustor in which the oxidizer is introduced in an axial direction into three discrete annuli at an inlet end of the rotating detonation combustor, according to a third aspect of the present disclosure;

FIG. 6 is a schematic depiction of a cross-section and an end view of a fourth exemplary rotating detonation combustor in which the oxidizer is introduced in a radial direction into three discrete flow passages that direct flow into three discrete annuli, according to a fourth aspect of the present disclosure; and FIG. 7 is a schematic depiction of a cross-section and an end view of a fifth exemplary rotating detonation combustor in which the oxidizer is introduced in a radial direction into three discrete flow passages at an inlet end of the rotating detonation combustor, according to a fifth aspect of the present disclosure.

DETAILED DESCRIPTION

Reference will now be made in detail to various embodiments of the present disclosure, one or more examples of which are illustrated in the accompanying drawings. The detailed description uses numerical and letter designations to refer to features in the drawings. Like or similar designations in the drawings and description have been used to refer to like or similar parts of the disclosure.

To clearly describe the current rotating detonation combustor with discrete detonation annuli, certain terminology will be used to refer to and describe relevant machine components within the scope of this disclosure. To the extent possible, common industry terminology will be used and employed in a manner consistent with the accepted meaning of the terms. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single integrated part.

In addition, several descriptive terms may be used regularly herein, as described below. The terms "first", "second", and "third" may be used interchangeably to distinguish one component from another and are not intended to signify location or importance of the individual components.

As used herein, "downstream" and "upstream" are terms that indicate a direction relative to the flow of a fluid, such as the working fluid through the turbine engine. The term "downstream" corresponds to the direction of flow of the fluid, and the term "upstream" refers to the direction opposite to the flow (i.e., the direction from which the fluid flows). The terms "forward" and "aft," without any further specificity, refer to relative position, with "forward" being used to describe components or surfaces located toward the front (or compressor) end of the engine or toward the inlet end of the combustor, and "aft" being used to describe components located toward the rearward (or turbine) end of the engine or toward the outlet end of the combustor. The term "inner" is used to describe components in proximity to the turbine shaft or longitudinal axis of the combustor, while the term "outer" is used to describe components distal to the turbine shaft or longitudinal axis of the combustor.

It is often required to describe parts that are at differing radial, axial and/or circumferential positions. As shown in FIG. 2, the "A" axis represents an axial orientation. As used herein, the terms "axial" and/or "axially" refer to the relative position/direction of objects along axis A, which is substantially parallel with the axis of rotation of the gas turbine system. As further used herein, the terms "radial" and/or "radially" refer to the relative position or direction of objects along an axis "R", which intersects axis A at only one location. In some embodiments, axis R is substantially perpendicular to axis A. Finally, the term "circumferential" refers to movement or position around axis A (e.g., axis "C"). The term "circumferential" may refer to a dimension extending around a center of a respective object (e.g., a rotor).

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents.

Although exemplary embodiments of the present disclosure will be described generally in the context of rotating detonation combustors for use in aircraft propulsion for purposes of illustration, one of ordinary skill in the art will readily appreciate that embodiments of the present disclosure may be applied to land-based power-generating gas turbines as well.

Referring now to the drawings, FIG. 2 illustrates a side view of a rotating detonation combustor 100, according to various embodiments disclosed herein. The combustor 100 includes a combustion tube 102 extending between an inlet end 110 and an outlet end 120. The combustion tube 102 includes an inner wall 106 and an outer wall 108 radially spaced from, and circumferentially surrounding, the inner wall 106 to define an annular passage 104 therebetween.

In the present embodiments, the annular passage (e.g., 104) is symmetrical about a centerline 105, or longitudinal axis, of the combustor 100, which may be co-linear with the engine centerline. In this context, the term "annular" is not limited to a passage defining a circular cross-section. Rather, the term "annular" broadly encompasses any unobstructed passage of any shape that circumferentially surrounds the centerline 105 and that defines a passage through which a fluid (e.g., combustion products) may flow.

The inlet end 110 of the combustor 100 includes a forward wall 114, while the outlet end 120 includes an aft wall 124. The forward wall 114 defines the upstream boundary of the annular passage 104, while the aft wall 124 defines the downstream boundary of the annular passage 104.

A plenum 130 is fluidly coupled to the combustor tube 102 upstream of a fluid inlet 132 for delivering air, oxidizer, or other fluids to the annular passage 104. In the illustrated embodiment, the plenum 130 is an air plenum, which receives air from an air supply (such as a compressor, not shown). However, the plenum 130 may instead deliver a mixture of fuel and air into the annular passage 104.

The plenum 130 is defined within a first sidewall 134 (that defines a radially outer boundary of the plenum 130), a second sidewall 136 (that defines a radially inner boundary of the plenum 130), and a plenum end wall 137 (that defines an axially aft boundary of the plenum 130). Each of the first and second sidewalls 134, 136 extend in an axial, or substantially axial, direction. A curved transition portion 135 extends between the first sidewall 134 and the forward wall 114 of the combustor tube 102. The plenum end wall 137 extends between the second sidewall 136 and the inner wall 106 of the combustor tube 102. Specifically, the plenum end wall 137 defines a curved surface extending from the second sidewall 136, which includes a concave portion that opens in the direction of fluid flow into the plenum 130. The curved surface of the plenum end wall 136 forms a generally radial transition to the fluid inlet 132 at the inlet end 110 of the combustor tube 102.

Fuel injectors 140 may be disposed in a circumferential array through the forward wall 114 positioned at a radial location corresponding to the fluid inlet 132. The fuel injectors 140 may be disposed in the forward wall 114 that is axially forward of the inner wall 106. The fuel injectors 140 disperse fuel from a fuel supply 144, via fuel inlets 142, into the inlet air, as the inlet air flows in a radially outward direction through the fluid inlet 132 and into the combustor annular passage 104.

In the illustrated embodiment, the fuel inlets 142 disperse fuel in an axial direction, orthogonal to the direction of flow of the inlet air, which flows into the annulus 104 in a radially outward direction. A fuel line 146 fluidly couples the fuel supply 144 to the one or more fuel injectors 140 for deliver fuel to the one or more fuel injectors 140. A first fuel control valve 148 is fluidly coupled to the fuel line 146.

In the exemplary combustors described herein, the air and fuel are introduced in discrete mixing zones that are defined between the inner and outer walls (e.g., 106, 108) and one or more partitions. In some embodiments (such as those shown in FIGS. 3 and 4), the partition extends along the axial length of the combustor from the forward wall to the combustor outlet. In other embodiments (such as that shown in FIGS. 5 and 7), the partitions are disposed at the forward end of the combustor, whether the combustor is configured for axial air entry (as in FIG. 5) or radial air entry (as in FIG. 7). FIG. 6 illustrates an embodiment of a combustor with radial air entry, in which each partition has a divider that extends in a radial direction and a plenum wall that is coupled to the divider and that extends in an axial direction to the combustor outlet.

FIG. 3 illustrates a rotating detonation combustor 200, according to a first aspect of the present disclosure. The rotating detonation combustor 200 includes an inner wall 206 and an outer wall 208 that is radially outward of, and that circumferentially surrounds, the inner wall 206. The inner wall 206 and the outer wall 208 are concentric about a common longitudinal axis 205. The inner wall 206 is coupled to the outer wall 208, via a forward wall 214, at an inlet end 210 of the combustor 200.

An intermediate plenum wall 255 is disposed radially between the inner wall 206 and the outer wall 208, thereby producing a first annular plenum 203 between the inner wall 206 and the plenum wall 255 and a second annular plenum 204 between the plenum wall 255 and the outer wall 208. In the illustrated embodiment, the intermediate plenum wall 255 extends over the axial length (or a majority of the axial length) of the combustor 200, causing the plenums 203, 204 to be fluidly isolated from one another. In this configuration, the plenum wall 255 functions as a partition that defines the annular plenums 203, 204 and that defines separate mixing zones at the forward end of the combustor 200.

In the illustrated embodiment, the plenum wall 255 is uniformly spaced between the radially inner wall 206 and the radially outer wall 208. In other embodiments (not shown), the plenum wall 255 may be disposed non-uniformly between the radially inner wall 206 and the radially outer wall 208. That is, the plenum wall 255 may be closer to the radially inner wall 206 or to the radially outer wall 208 to produce plenums 203, 204 of different sizes.

Oxidizer (e.g., air from a compressor, not shown) is directed in an axial direction through air inlets 232 in the forward wall 214. Fuel circuits 250, 260 are axially spaced to deliver fuel into the oxidizer flowing into the plenums 204, 203, respectively. In the radially inward plenum 203, the fuel is introduced via fuel inlets 252 defined through the inner wall 206 and/or the plenum wall 255. In the radially outward plenum 204, the fuel is introduced via fuel inlets 262 defined through the plenum wall 255 and/or the outer wall 208.

Although the arrows indicate fuel flow into each plenum in a radially inward and a radially outward direction, it should be understood that the fuel flow into each plenum 203, 204 may be delivered in a single direction (radially inward or radially outward), and there is no requirement that both plenums 203, 204 receive fuel in the same direction of flow. Moreover, the fuel flow into one or both plenums 203, 204 may occur at a tangential angle relative to the axial flow of oxidizer through the forward wall 214.

In the radially inward plenum 203, fuel and oxidizer ignite at one or more detonation fronts 216 and produce one or more detonation waves 218 that travel through the annular plenum 203 to the outlet end 220 of the combustor 200. In the radially outward plenum 204, the fuel and oxidizer ignite at a detonation front 226 and produce one or more detonation waves 228 that travel through the annular plenum 204 to the outlet end 220 of the combustor 200.

In the illustrated embodiment, the detonation waves 218 in the radially inward plenum 203 are co-rotating relative to one another, meaning that the detonation waves 218 are travelling in the same circumferential direction. Similarly, the detonation waves 228 in the radially outward plenum 204 are co-rotating with one another. However, in the exemplary embodiment, the detonation waves 218 rotate in a first direction (e.g., clockwise), while the detonation waves 228 rotate in a second direction opposite the first direction (e.g., counterclockwise).

Alternately, the detonation waves 218 may be counter-rotating within the radially inward plenum 203 and/or the detonation waves 228 may be counter-rotating within the radially outward plenum 204. In another embodiment, the detonation waves 218 and the detonation waves 228 may rotate in a single direction (i.e., clockwise or counter-clockwise).

It should be understood that the fuel may be supplied independently to the combustor from the fuel circuits 250, 260. That is, the second fuel circuit 260 may deliver fuel to the radially inward plenum 203, while the first fuel circuit 250 remains idle. Alternately, the first fuel circuit 250 may deliver fuel to the radially outward plenum 204, while the second fuel circuit 260 remains idle. In some circumstances, it may be desirable to provide different amounts of fuel through the fuel circuits 250, 260. By providing greater flexibility over the delivery of fuel to the respective plenums 203, 204, a greater degree of operational freedom is achieved (e.g., at start-up, loading, and turndown).

FIG. 4 illustrates a rotating detonation combustor 300, according to a second aspect of the present disclosure. The rotating detonation combustor 300 includes an inner wall 306 and an outer wall 308 that is radially outward of, and that circumferentially surrounds, the inner wall 306. The inner wall 306 and the outer wall 308 are concentric about a common longitudinal axis 305. The inner wall 306 is coupled to the outer wall 308, via a forward wall 314, at an inlet end 310 of the combustor 300.

The combustor 300 includes a first intermediate plenum wall 355 and a second intermediate plenum wall 365, which are positioned in a concentric relationship between the inner wall 306 and the outer wall 308. The first intermediate plenum wall 355 is disposed radially outward of the radially inner wall 306, thereby producing a first annular plenum 302 between the inner wall 306 and the first plenum wall 355. The second intermediate plenum wall 365 is disposed radially inward of the radially outer wall 308 and radially outward of the first plenum wall 355, thereby producing a second annular plenum 303 between the first plenum wall 365 and the second plenum wall 365 and a third annular plenum 304 between the second plenum wall 365 and the radially outer wall 308. In the illustrated embodiment, the intermediate plenum walls 355, 365 extend over the axial length (or a majority of the axial length) of the combustor 300 and function as partitions within the combustor 300, causing the plenums 302, 303, 304 and the associated mixing zones to be fluidly isolated from one another.

In the illustrated embodiment, the plenum walls 355, 365 are uniformly spaced between the radially inner wall 306 and the radially outer wall 308, although such spacing is not required.

Oxidizer (e.g., air from a compressor, not shown) is directed in an axial direction through air inlets 332 in the forward wall 314. Fuel circuits 350, 360, 370 are axially spaced to deliver fuel into the oxidizer flowing into the plenums 304, 303, 302, respectively. In the radially inward plenum 302, the fuel is introduced via fuel inlets 372 defined through the inner wall 306 and/or the first plenum wall 355. In the radially intermediate (central) plenum 303, the fuel is introduced via fuel inlets 362 defined through the first plenum wall 355 and/or the second plenum wall 365. In the radially outward plenum 304, the fuel is introduced via fuel inlets 352 defined through the second plenum wall 365 and/or the outer wall 308.

Although the arrows indicate fuel flow into each plenum in a radially inward and a radially outward direction, it should be understood that the fuel flow into each plenum 302, 303, 304 may be delivered in a single direction (radially inward or radially outward), and there is no requirement that all plenums 302, 303, 304 receive fuel in the same direction of flow. Moreover, the fuel flow into one, some, or all of plenums 302, 303, 304 may occur at a tangential angle relative to the axial flow of oxidizer through the forward wall 314.

In the radially inward plenum 302, fuel and oxidizer ignite at one or more detonation fronts 316 and produce one or more detonation waves 318 that travel through the annular plenum 302 to the outlet end 320 of the combustor 300. In the radially intermediate (center) plenum 303, fuel and oxidizer ignite at one or more detonation fronts 326 and produce one or more detonation waves 328 that travel through the annular plenum 303 to the outlet end 320 of the combustor 300. In the radially outward plenum 304, the fuel and oxidizer ignite at a detonation front 336 and produce one or more detonation waves 338 that travel through the annular plenum 304 to the outlet end 320 of the combustor 300.

In the illustrated embodiment, the detonation waves 318 in the radially inward plenum 302 are co-rotating relative to one another, meaning that the detonation waves 318 are travelling in the same circumferential direction. Similarly, the detonation waves 328 in the radially intermediate plenum 303 are co-rotating with one another; and the detonation waves 338 in the radially outer plenum 304 are co-rotating with one another. However, in the exemplary embodiment, the detonation waves 318, 338 rotate in a first direction (e.g., clockwise), while the detonation waves 328 rotate in a second direction opposite the first direction (e.g., counterclockwise).

Alternately, the detonation waves 318 may be counter-rotating within the radially inward plenum 302, the detonation waves 328 may be counter-rotating within the radially intermediate plenum 303, and/or the detonation waves 338 may be counter-rotating within the radially outward plenum 304. In another embodiment, all the detonation waves 318, 328, 338 may rotate in a single direction.

It should be understood that the fuel may be supplied independently to the combustor 300 from the fuel circuits 350, 360, 370. That is, one or more fuel circuits may deliver fuel to a respective fuel plenum, while one or more other fuel circuits remain idle. In some circumstances, it may be desirable to provide different amounts of fuel through the fuel circuits 350, 360, 370. By providing greater flexibility over the delivery of fuel to the respective plenums 302, 303, 304, an even greater degree of operational freedom is achieved (e.g., at start-up, loading, and turndown).

FIG. 5 illustrates a rotating detonation combustor 400, according to a third aspect of the present disclosure. The rotating detonation combustor 400 includes an inner wall 406 and an outer wall 408 that is radially outward of, and that circumferentially surrounds, the inner wall 406. The inner wall 406 and the outer wall 408 are concentric about a common longitudinal axis 405. The inner wall 406 is coupled to the outer wall 408, via a forward wall 414, at an inlet end 410 of the combustor 400.

The combustor 400 includes a first intermediate divider 485 and a second intermediate divider 495, which are positioned in a concentric relationship between the inner wall 406 and the outer wall 408 at the inlet end 410 of the combustor 400. The first intermediate divider 485 is disposed radially outward of the radially inner wall 406, thereby producing a first annular mixing zone 480 between the inner wall 406 and the first intermediate divider 485. The second intermediate divider 495 is disposed radially inward of the radially outer wall 408 and radially outward of the first intermediate divider 485, thereby producing a second annular mixing zone 482 between the first divider 485 and the second divider 495 and a third annular mixing zone 484 between the second divider 495 and the radially outer wall 408. In the illustrated embodiment, the intermediate dividers 485, 495 extend over only an upstream portion of the axial length of the combustor 400. These partitions (that is, dividers 485, 495) cause the fuel and oxidizer to be mixed in separate mixing zones 482, 484, although detonation of the fuel/oxidizer mixtures occurs in a common plenum 404 downstream of the dividers 485, 495.

In the illustrated embodiment, the dividers 485, 495 are uniformly spaced between the radially inner wall 406 and the radially outer wall 408, although such spacing is not required.

Oxidizer (e.g., air from a compressor, not shown) is directed in an axial direction through air inlets 432 in the forward wall 414. Fuel circuits 450, 460, 470 are axially spaced to deliver fuel into the oxidizer flowing into the mixing zones 484, 482, 480, respectively. In the radially inward mixing zone 480, the fuel is introduced via fuel inlets 472 defined through the inner wall 406 and/or the first divider 485. In the radially intermediate (central) mixing one 482, the fuel is introduced via fuel inlets 462 defined through the first divider 485 and/or the second divider 495. In the radially outward mixing zone 484, the fuel is introduced via fuel inlets 452 defined through the second divider 495 and/or the outer wall 408.

Although the arrows indicate fuel flow into each plenum in a radially inward and a radially outward direction, it should be understood that the fuel flow into each mixing zone 480, 482, 484 may be delivered in a single direction (radially inward or radially outward), and there is no requirement that all mixing zones 480, 482, 484 receive fuel in the same direction of flow. Moreover, the fuel flow into one, some, or all of mixing zones 480, 482, 484 may occur at a tangential angle relative to the axial flow of oxidizer through the forward wall 414.

After mixing in the mixing zones 480, 482, 484, the fuel and oxidizer ignite at one or more detonation fronts 416 within an annular plenum 404 defined between the inner wall 406 and the outer wall 408. The resulting one or more detonation waves 418 travel through the annular plenum 406 to the outlet end 420 of the combustor 400.

In the illustrated embodiment, the detonation waves 418 in the plenum 402 are counter-rotating relative to one another, meaning that the detonation waves 418 are travelling in the opposite circumferential directions. Alternately, the detonation waves 418 may be co-rotating within the plenum 402.

It should be understood that the fuel may be supplied independently to the combustor 400 from the fuel circuits 450, 460, 470. That is, one or more fuel circuits may deliver fuel to a respective mixing zone, while one or more other fuel circuits remain idle. In some circumstances, it may be desirable to provide different amounts of fuel through the fuel circuits 450, 460, 470. By providing greater flexibility over the delivery of fuel to the respective mixing zones 480, 482, 484, an even greater degree of operational freedom is achieved (e.g., at start-up, loading, and turndown).

FIG. 6 illustrates a rotating detonation combustor 500, according to a fourth aspect of the present disclosure. The rotating detonation combustor 500 is configured to receive a flow of oxidizer in a radial direction and a flow of fuel in an axial direction. The rotating detonation combustor 500 includes a first inlet wall 514 and a second inlet wall 515 spaced axially downstream of the first inlet wall 514, which define an inlet end 510 of the combustor 500. The second inlet wall 515 is coupled to an inner wall 506, and the first inlet wall 514 is coupled to an outer wall 508 that is radially outward of, and that circumferentially surrounds, the inner wall 506. The inner wall 506 and the outer wall 508 are concentric about a common longitudinal axis 505.

In this embodiment, the combustor 500 includes one or more partitions having a radially oriented segment (a "divider") coupled to an axially oriented segment (a "plenum wall"). Specifically, the combustor 500 includes a first divider 554 and a second divider 564 axially downstream of the first divider 554, both of which are disposed between the first inlet wall 514 and the second inlet wall 515. The combustor 500 further includes a first intermediate plenum wall 555 and a second intermediate plenum wall 565, which are positioned in a concentric relationship between the inner wall 506 and the outer wall 508. The first intermediate plenum wall 555 is coupled to the first divider 554, and the second intermediate plenum wall 565 is coupled to the second divider 564, thereby partitioning the flow path of the fuel/oxidizer from the inlet end 510 to the outlet end 520.

The first intermediate plenum wall 565 is disposed radially outward of the radially inner wall 506, thereby producing a first annular plenum 502 between the inner wall 506 and the first plenum wall 565. The second intermediate plenum wall 555 is disposed radially inward of the radially outer wall 508 and radially outward of the first plenum wall 565, thereby producing a second annular plenum 503 between the first plenum wall 565 and the second plenum wall 555 and a third annular plenum 504 between the second plenum wall 555 and the radially outer wall 508. In the illustrated embodiment, the intermediate plenum walls 555, 565 extend over the axial length (or a majority of the axial length) of the combustor 500, causing the plenums 502, 503, 504 to be fluidly isolated from one another.

In the illustrated embodiment, the plenum walls 555, 565 are non-uniformly spaced between the radially inner wall 506 and the radially outer wall 508. Specifically, the plenum walls 555, 565 are disposed in relatively close proximity to the radially outer wall 508 and the radially inner wall 506, respectively, causing the intermediate plenum 503 to be larger than the plenums 502, 504. Other spacing of the plenum walls 555, 565 (including uniform spacing) may instead be used, as needs dictate.

Oxidizer (e.g., air from a compressor, not shown) is directed in a radially outward direction from the longitudinal axis 505 through air inlets 532. Fuel circuits 550, 560, 570 are radially spaced to deliver fuel into the oxidizer flowing into the inlet mixing zones 584, 582, 580, respectively. In the axially aft mixing zone 580, the fuel is introduced via fuel inlets 552 defined through the second divider 564 (as shown) and/or the second inlet wall 515 (not shown). In the axially intermediate (central) mixing zone 582, the fuel is introduced via fuel inlets 562 defined through the first divider 554 (as shown) and/or the second divider 564 (not shown). In the axially forward mixing zone 584, the fuel is introduced via fuel inlets 572 defined through the first inlet wall 514 (as shown) and/or the first divider 554 (not shown).

Although the arrows indicate fuel flow into each plenum in a single axial direction, it should be understood that the fuel flow into each mixing zone 580, 582, 584 may be delivered in both upstream and downstream axial directions, and there is no requirement that all mixing zones 580, 582, 584 receive fuel in the same direction of flow. Moreover, the fuel flow into one, some, or all of mixing zones 580, 582, 584 may occur at a tangential angle relative to the radial flow of oxidizer through the air inlets 532.

The fuel/oxidizer mixture from the axially aft mixing zone 580 flows into the radially inward plenum 502. In the radially inward plenum 502, fuel and oxidizer ignite at one or more detonation fronts 516 and produce one or more detonation waves 518 that travel through the annular plenum 502 to the outlet end 520 of the combustor 500.

The fuel/oxidizer mixture from the axially intermediate mixing zone 582 flows into the radially intermediate plenum 503. In the radially intermediate (center) plenum 503, fuel and oxidizer ignite at one or more detonation fronts 526 and produce one or more detonation waves 528 that travel through the annular plenum 503 to the outlet end 520 of the combustor 500.

The fuel/oxidizer mixture from the axially forward mixing zone 584 flows into the radially outward plenum 504. In the radially outward plenum 504, the fuel and oxidizer ignite at a detonation front 536 and produce one or more detonation waves 538 that travel through the annular plenum 504 to the outlet end 520 of the combustor 500.

In the illustrated embodiment, the detonation waves 518 in the radially inward plenum 502 are counter-rotating relative to one another, meaning that the detonation waves 518 are travelling in the opposite circumferential direction. Similarly, the detonation waves 528 in the radially intermediate plenum 503 are counter-rotating with one another; and the detonation waves 538 in the radially outer plenum 304 are counter-rotating with one another.

Alternately, the detonation waves 518 may be co-rotating within the radially inward plenum 502, the detonation waves 528 may be co-rotating within the radially intermediate plenum 503, and/or the detonation waves 538 may be co-rotating within the radially outward plenum 504. In another embodiment, the detonation waves 518, 528, 538 may rotate in opposite directions from plenum to plenum.

It should be understood that the fuel may be supplied independently to the combustor 500 from the fuel circuits 550, 560, 570. That is, one or more fuel circuits may deliver fuel to a respective fuel plenum, while one or more other fuel circuits remain idle. In some circumstances, it may be desirable to provide different amounts of fuel through the fuel circuits 550, 560, 570. By providing greater flexibility over the delivery of fuel to the respective plenums 502, 503, 504, an even greater degree of operational freedom is achieved (e.g., at start-up, loading, and turndown).

As shown in FIG. 6, the divider walls 554, 564 and the associated plenum walls 555, 565 may be arranged to define plenums 502, 503, 504 of different sizes. In some instances, for example, it may be desirable that the intermediate plenum 503 define a larger area than the plenums 502, 504 immediately adjacent the inner wall 506 and the outer wall 508, respectively.

FIG. 7 illustrates a rotating detonation combustor 600, according to a fifth aspect of the present disclosure. The rotating detonation combustor 600 is configured to receive a flow of oxidizer in a radial direction and a flow of fuel in an axial direction. The rotating detonation combustor 600 includes a first inlet wall 614 and a second inlet wall 615 spaced axially downstream of the first inlet wall 614, which define an inlet end 610 of the combustor 600. The second inlet wall 615 is coupled to an inner wall 606, and the first inlet wall 614 is coupled to an outer wall 608 that is radially outward of, and that circumferentially surrounds, the inner wall 606. The inner wall 606 and the outer wall 608 are concentric about a common longitudinal axis 605.

The combustor 606 includes a first divider 685 and a second divider 695 axially downstream of the first divider 685, both of which are disposed between the first inlet wall 614 and the second inlet wall 615. The first divider 685 and the second divider 695 extend from the air inlets 632 to the plane defined by the inner wall 606, thereby partitioning the inlet end 610 into separate mixing zones 680, 682, 684.

In the illustrated embodiment, the dividers 685, 695 are uniformly spaced between the first inlet wall 614 and the second inlet wall 615, although such spacing is not required.

Oxidizer (e.g., air from a compressor, not shown) is directed in a direction radially outward from the longitudinal axis 605 through air inlets 632. Fuel circuits 650, 660, 670 are radially spaced to deliver fuel into the oxidizer flowing into the inlet mixing zones 680, 682, 684, respectively. In the axially forward mixing zone 680, the fuel is introduced via fuel inlets 652 defined through the first inlet wall 614 (as shown) and/or the first divider 685 (not shown). In the axially intermediate (central) mixing zone 682, the fuel is introduced via fuel inlets 662 defined through the first divider 685 (as shown) and/or the second divider 695 (not shown). In the axially aft mixing zone 684, the fuel is introduced via fuel inlets 672 defined through the second divider 695 (as shown) and/or the second inlet wall 615 (not shown).

Although the arrows indicate fuel flow into each plenum in a single axial direction, it should be understood that the fuel flow into each mixing zone 680, 682, 684 may be delivered in both upstream and downstream axial directions, and there is no requirement that all mixing zones 680, 682, 684 receive fuel in the same direction of flow. Moreover, the fuel flow into one, some, or all of mixing zones 680, 682, 684 may occur at a tangential angle relative to the radial flow of oxidizer through the air inlets 632.

The fuel/oxidizer mixtures from the axially forward mixing zone 680, the axially intermediate mixing zone 682, and the axially aft mixing zone 684 flow into a common annular plenum 604 defined between the inner wall 606 and the outer wall 608. In the common annular plenum 604, the fuel and oxidizer ignite at one or more detonation fronts 616 and produce one or more detonation waves 618 that travel through the annular plenum 604 to the outlet end 620 of the combustor 600.

In the illustrated embodiment, the detonation waves 618 in the common plenum 604 are co-rotating relative to one another, meaning that the detonation waves 618 are travelling in the same circumferential direction. Alternately, the detonation waves 618 may be counter-rotating within the common plenum 604.

It should be understood that the fuel may be supplied independently to the combustor 600 from the fuel circuits 650, 660, 670. That is, one or more fuel circuits may deliver fuel to a respective mixing zone, while one or more other fuel circuits remain idle. In some circumstances, it may be desirable to provide different amounts of fuel through the fuel circuits 650, 660, 670. By providing greater flexibility over the delivery of fuel to the respective mixing zones 680, 682, 684, an even greater degree of operational freedom is achieved (e.g., at start-up, loading, and turndown).

Exemplary embodiments of the rotating detonation combustor with discrete detonation annuli are described above in detail. The rotating detonation combustors described herein are not limited to the specific embodiments described herein, but rather, components of the rotating detonation combustor may be utilized independently and separately from other components described herein.

While the technical advancements have been described in terms of various specific embodiments, those skilled in the art will recognize that the technical advancements can be practiced with modification within the spirit and scope of the claims.

What is claimed is:

1. A rotating detonation combustor comprising:

a forward wall disposed at an inlet end of the rotating detonation combustor;

a radially inner wall surrounding a longitudinal axis and extending downstream from the forward wall to an outlet end of the rotating detonation combustor;

a radially outer wall extending downstream from the forward wall to the outlet end, the radially outer wall surrounding the radially inner wall to define at least one annular plenum between the radially inner wall and the radially outer wall;

at least one plenum wall proximate to the inlet end and defining a plurality of mixing zones, the at least one plenum wall comprising a first plenum wall and a second plenum wall, each of the first plenum wall and the second plenum wall being uniformly spaced between the radially inner wall and the radially outer wall such that each mixing zone of the plurality of mixing zones have equal spacing in a radial direction;

a plurality of oxidizer inlets disposed in the forward wall and in fluid communication with the plurality of mixing zones;

at least one fuel inlet disposed in each of the radially inner wall and the radially outer wall and in fluid communication with the plurality of mixing zones;

a first fuel inlet configured to introduce fuel into a first mixing zone of the plurality of mixing zones and extending between an outer surface of the first plenum wall and an inner surface of the first plenum wall;

a second fuel inlet configured to introduce fuel into a second mixing zone of the plurality of mixing zones and extending between the inner surface of the first plenum wall and the outer surface of the first plenum wall;

a third fuel inlet configured to introduce fuel into the second mixing zone, the third fuel inlet axially aligned with the second fuel inlet and extending between an outer surface of the second plenum wall and an inner surface of the second plenum wall; and a fourth fuel inlet configured to introduce fuel into a third mixing zone of the plurality of mixing zones, the fourth fuel inlet extending between the inner surface of the second plenum wall and the outer surface of the second plenum wall, wherein the plurality of mixing zones are fluidly isolated from one another, and wherein both the at least one fuel inlet disposed in the radially inner wall and the first fuel inlet are axially spaced from each of the at least one fuel inlet disposed in the radially outer wall, the second fuel inlet, the third fuel inlet, and the fourth fuel inlet.

2. The rotating detonation combustor of claim 1, wherein the first plenum wall is disposed radially outward of the radially inner wall and the second plenum wall is disposed radially between the first plenum wall and the radially outer wall.

3. The rotating detonation combustor of claim 1, wherein the first plenum wall and the second plenum wall extend axially from the forward wall to the outlet end.

4. The rotating detonation combustor of claim 1, wherein the rotating detonation combustor is configured to produce a first pair of detonation waves in a first plenum between the radially inner wall and the first plenum wall; a second pair of detonation waves in a second plenum between the first plenum wall and the second plenum wall; and a third pair of detonation waves in a third plenum between the second plenum wall and the radially outer wall.

5. The rotating detonation combustor of claim 4, wherein at least one pair of the first pair of detonation waves, the second pair of detonation waves, and the third pair of detonation waves rotate in the same direction through a respective first, second, or third plenum.

6. The rotating detonation combustor of claim 4, wherein each pair of the first pair of detonation waves, the second pair of detonation waves, and the third pair of detonation waves rotate in the same direction through a respective first, second, or third plenum.

7. The rotating detonation combustor of claim 6, wherein the first pair of detonation waves rotates in a first direction through the first plenum, the second pair of detonation waves rotates in a second direction through the second plenum, and the third pair of detonation waves rotates in the first direction through the third plenum.

8. The rotating detonation combustor of claim 4, wherein at least one pair of the first pair of detonation waves, the second pair of detonation waves, and the third pair of detonation waves rotate in opposite directions through a respective first, second, or third plenum.

9. The rotating detonation combustor of claim 1, wherein the plurality of oxidizer inlets is oriented to direct oxidizer in an axial direction, and wherein each of the at least one fuel inlet, the first fuel inlet, and the second fuel inlet is oriented to direct fuel in the radial direction.

10. The rotating detonation combustor of claim 1, wherein the at least one fuel inlet disposed in the radially inner wall and the first fuel inlet are coupled to a first fuel circuit and the at least one fuel inlet disposed in the radially outer wall and the fourth fuel inlet are coupled to a second fuel circuit operated independently of the first fuel circuit.

11. The rotating detonation combustor of claim 1, wherein the at least one fuel inlet disposed in the radially inner wall introduces fuel into the first mixing zone and the at least one fuel inlet disposed in the radially outer wall introduces fuel into the third mixing zone.

12. The rotating detonation combustor of claim 11, wherein the at least one fuel inlet disposed in the radially inner wall and the first fuel inlet introduce fuel into the first mixing zone in radially opposite directions, and wherein the at least one fuel inlet disposed in the radially outer wall and the fourth fuel inlet introduce fuel into the second mixing zone in radially opposite directions.

13. The rotating detonation combustor of claim 1, wherein the at least one fuel inlet disposed in the radially inner wall is axially aligned with the first fuel inlet and the at least one fuel inlet disposed in the radially outer wall is axially aligned with the fourth fuel inlet.

14. A rotating detonation combustor having an inlet end, an outlet end, and longitudinal centerline axis, the rotating detonation combustor comprising:

a forward wall disposed at the inlet end;

a radially inner cylindrical wall extending downstream from the forward wall to the outlet end;

a radially outer cylindrical wall circumferentially surrounding the radially inner cylindrical wall and extending downstream from the forward wall to the outlet end;

a cylindrical plenum wall located circumferentially between the radially inner cylindrical wall and the radially outer cylindrical wall, the cylindrical plenum wall, the radially inner cylindrical wall, and the radially outer cylindrical wall being concentric about the longitudinal centerline axis;

a first mixing zone defined between an inner surface of the cylindrical plenum wall and the radially inner cylindrical wall;

a second mixing zone defined between an outer surface of the cylindrical plenum wall and the radially outer cylindrical wall, the second mixing zone having equal spacing in a radial direction as the first mixing zone from the forward wall to an aftmost end of the cylindrical plenum wall;

a first oxidizer inlet disposed in the forward wall and configured to introduce an oxidizer in an axial direction into the first mixing zone;

a second oxidizer inlet disposed in the forward wall and configured to introduce the oxidizer in the axial direction into the second mixing zone;

a first fuel inlet extending through the radially inner cylindrical wall and a second fuel inlet extending through the cylindrical plenum wall such that a fuel flow through the second fuel inlet flows from the outer surface of the cylindrical plenum wall to the inner surface of the cylindrical plenum wall, the first fuel inlet and the second fuel inlet being axially aligned and configured to introduce a fuel flow in opposing radial directions to the first mixing zone; and a third fuel inlet extending through the radially outer cylindrical wall and a fourth fuel inlet extending through the cylindrical plenum wall such that a fuel flow through the fourth fuel inlet flows from the inner surface of the cylindrical plenum wall to the outer surface of the cylindrical plenum wall, the third fuel inlet and the fourth fuel inlet being axially aligned and configured to introduce the fuel flow in opposing radial directions to the second mixing zone, wherein the first fuel inlet and the second fuel inlet are axially spaced from the third fuel inlet and the fourth fuel inlet, and wherein the first fuel inlet and the fourth fuel inlet are configured to introduce the fuel flow in a radially outward direction, and the second fuel inlet and the third fuel inlet are configured to introduce the fuel flow in a radially inward direction.

15. A rotating detonation combustor having an inlet end, an outlet end, and longitudinal centerline axis, the rotating detonation combustor comprising:

a forward wall disposed at the inlet end;

a radially inner cylindrical wall extending downstream from the forward wall to the outlet end;

a radially outer cylindrical wall circumferentially surrounding the radially inner cylindrical wall and extending downstream from the forward wall to the outlet end;

a first cylindrical plenum wall located circumferentially between the radially inner cylindrical wall and the radially outer cylindrical wall;

a second cylindrical plenum wall located circumferentially between the radially inner cylindrical wall and the first cylindrical plenum wall, the first cylindrical plenum wall, the second cylindrical plenum wall, the radially inner cylindrical wall, and the radially outer cylindrical wall being concentric about the longitudinal centerline axis;

a first mixing zone defined between an outer surface of the first cylindrical plenum wall and the radially outer cylindrical wall;

a second mixing zone defined between an inner surface of the first cylindrical plenum wall and an outer surface of the second cylindrical plenum wall; and a third mixing zone defined between an inner surface of the second cylindrical plenum wall and the radially inner cylindrical wall, the first mixing zone, the second mixing zone, and the third mixing zone each having equal spacing in a radial direction from the forward wall to an aftmost end of each of the first cylindrical plenum wall and the second cylindrical plenum wall;

a first oxidizer inlet disposed in the forward wall and configured to introduce an oxidizer in an axial direction into the first mixing zone;

a second oxidizer inlet disposed in the forward wall and configured to introduce the oxidizer in the axial direction into the second mixing zone;

a third oxidizer inlet disposed in the forward wall and configured to introduce the oxidizer in the axial direction into the third mixing zone;

a first fuel inlet extending through the radially outer cylindrical wall and a second fuel inlet extending through the first cylindrical plenum wall between the inner surface and the outer surface of the first cylindrical plenum wall, the first fuel inlet and the second fuel inlet being axially aligned and configured to introduce a fuel flow in opposing radial directions to the first mixing zone;

a third fuel inlet extending through the first cylindrical plenum wall between the outer surface and the inner surface and a fourth fuel inlet extending through the second cylindrical plenum wall between the inner surface and the outer surface of the second cylindrical plenum wall, the third fuel inlet and the fourth fuel inlet being axially aligned and configured to introduce the fuel flow in opposing radial directions to the second mixing zone; and a fifth fuel inlet extending through the radially inner cylindrical wall and a sixth fuel inlet extending through the second cylindrical plenum wall from the outer surface to the inner surface of the second cylindrical plenum wall, the fifth fuel inlet and the sixth fuel inlet being axially aligned and configured to introduce the fuel flow in opposing radial directions to the third mixing zone, wherein the first fuel inlet and the second fuel inlet are axially spaced from the third fuel inlet and the fourth fuel inlet and axially spaced from the fifth fuel inlet and the sixth fuel inlet, wherein the third fuel inlet and the fourth fuel inlet are axially spaced from the fifth fuel inlet and the sixth fuel inlet, and wherein the first fuel inlet, the third fuel inlet, and the sixth fuel inlet are configured to introduce the fuel flow in a radially inward direction, and the second fuel inlet, the fourth fuel inlet, and the fifth fuel inlet are configured to introduce the fuel flow in a radially outward direction.

16. The rotating detonation combustor of claim 15, wherein the first cylindrical plenum wall and the second cylindrical plenum wall comprise dividers that extend axially from the forward wall at only a forward end of the rotating detonation combustor.

17. The rotating detonation combustor of claim 14, wherein the rotating detonation combustor is configured to produce a first pair of detonation waves in a first plenum between the radially inner cylindrical wall and the cylindrical plenum wall and a second pair of detonation waves in a second plenum between the cylindrical plenum wall and the radially outer cylindrical wall.

18. The rotating detonation combustor of claim 17, wherein the first pair of detonation waves and the second pair of detonation waves rotate in the same direction.

19. The rotating detonation combustor of claim 17, wherein the first pair of detonation waves and the second pair of detonation waves rotate in opposite directions.

* * * * *